US009577368B2

(12) United States Patent
Fukuda et al.

(10) Patent No.: US 9,577,368 B2
(45) Date of Patent: Feb. 21, 2017

(54) METHOD FOR MANUFACTURING CONNECTOR TERMINAL, AND CONNECTOR

(71) Applicants: Yazaki Corporation, Tokyo (JP); Aisin AW Co., Ltd., Anjo-shi (JP)

(72) Inventors: Kiyohito Fukuda, Makinohara (JP); Toru Nagano, Makinohara (JP); Katsutoshi Komatsu, Anjo (JP); Tomonari Okamoto, Anjo (JP)

(73) Assignees: Yazaki Corporation, Tokyo (JP); Aisin AW Co., Ltd., Anjo-Shi (JP)

( * ) Notice: Subject to any disclaimer, the term of this patent is extended or adjusted under 35 U.S.C. 154(b) by 7 days.

(21) Appl. No.: 14/661,341

(22) Filed: Mar. 18, 2015

(65) Prior Publication Data

US 2015/0194762 A1 Jul. 9, 2015

Related U.S. Application Data

(63) Continuation of application No. PCT/JP2013/075112, filed on Sep. 18, 2013.

(30) Foreign Application Priority Data

Sep. 19, 2012 (JP) ..... 2012-205430

(51) Int. Cl.

| | |
|---|---|
| ***H01R 13/02*** | (2006.01) |
| ***H01R 13/52*** | (2006.01) |
| ***H01R 13/03*** | (2006.01) |
| ***H01R 43/00*** | (2006.01) |
| *H01R 43/16* | (2006.01) |

(52) U.S. Cl.

CPC ..... *H01R 13/521* (2013.01); *H01R 13/03* (2013.01); *H01R 43/005* (2013.01); *H01R 43/16* (2013.01)

(58) Field of Classification Search

CPC .. H01R 13/03; H01R 13/521; H01R 13/5216; H01R 43/16; H01R 43/24

(Continued)

(56) References Cited

U.S. PATENT DOCUMENTS 5,326,273 A * 7/1994 Kamon ..... H01R 4/62 174/94 R
5,518,427 A * 5/1996 Kan ..... H01R 13/521 439/276

(Continued)

FOREIGN PATENT DOCUMENTS

JP 04-058486 A 2/1992
JP 09-161866 A 6/1997

(Continued)

OTHER PUBLICATIONS

Office Action mailed May 24, 2016, issued for the Chinese patent application No. 201380048408.X and English translation thereof.

(Continued)

*Primary Examiner* — Hien Vu
(74) *Attorney, Agent, or Firm* — Locke Lord LLP; Howard M. Gitten

(57) ABSTRACT

An object of the present invention is to provide a method for manufacturing a connector terminal received in a terminal-receiving chamber, passing through a sealing member, and brought into close contact with the sealing member, and a connector, which are the method for manufacturing a connector terminal, and the connector, for improvement in close contact between the sealing member and the connector terminal. Provided is a method for manufacturing a connector terminal received in a terminal-receiving chamber of a housing, passing through a sealing member filled in the terminal-receiving chamber, and brought into close contact with the sealing member, and the method includes a first process of punching a non-plated metal plate to form an intermediate material and a second process of covering the intermediate material with plating.

1 Claim, 4 Drawing Sheets

(58) Field of Classification Search
USPC ..... 439/885, 886, 936
See application file for complete search history.

(56) References Cited

U.S. PATENT DOCUMENTS

| | | | | |
|---|---|---|---|---|
| 6,102,739 | A * | 8/2000 | Murakami | F16H 61/0006 439/587 |
| 7,445,481 | B2 * | 11/2008 | Nagashima | H01R 13/521 439/276 |
| 8,011,976 | B2 * | 9/2011 | Ooki | H01R 13/50 439/736 |

FOREIGN PATENT DOCUMENTS

| | | | |
|---|---|---|---|
| JP | 09-245880 | A | 9/1997 |
| JP | 3358446 | B2 | 12/2002 |
| JP | 2006-140042 | A | 6/2006 |
| JP | 2012018889 | A | 1/2012 |
| JP | 2012059623 | A | 3/2012 |
| JP | 4993472 | B2 | 8/2012 |
| WO | WO-2005/024994 | A1 | 3/2005 |

OTHER PUBLICATIONS

International Search Report mailed Dec. 24, 2013, issued for PCT/JP2013/075112.
Notification of Reasons for Refusal mailed May 10, 2016, issued for the Japanese patent application No. 2012-205430 and English translation there.
Japanese Patent Office, Decision of Refusal drafted Jul. 11, 2016, issued in corresponding Japanese Patent Application No. 2012-205430.

* cited by examiner

METHOD FOR MANUFACTURING CONNECTOR TERMINAL, AND CONNECTOR

TECHNICAL FIELD

The present invention relates to a connector having a liquid sealing function and a method for manufacturing a connector terminal.

BACKGROUND ART

A number of relay connectors having a liquid sealing function are proposed (e.g., refer to Patent Literature 1).

A conventional relay connector described in Patent Literature 1 is configured to include a resin-made connector housing 103, a plurality of metal-made terminals 102 to be incorporated in this connector housing 103, and a rubber-made sealing member 104 as illustrated in FIG. 4. The connector housing 103 is formed by projecting a pair of hood portions 132 in tubular shapes on both sides of a partition wall portion 131. One hood portion 132 has a first connector connecting chamber 132A therein, and to this first connector connecting chamber 132A is connected a not-illustrated female-side connector. The other hood portion 132 has a second connector connecting chamber 132B therein, and to this second connector connecting chamber 132B is connected a not-illustrated female-side connector. The partition wall portion 131 is provided with a plurality of through holes 103*a* in which the plurality of terminals 102 are press-fitted to make the first connector connecting chamber 132A and the second connector connecting chamber 132B communicate with each other. The terminal 102 is formed in a flat-plate-like bar shape by cutting a wire rod. The sealing member 104 is formed approximately in a rectangular solid and is formed to be larger than the second connector connecting chamber 132B. The sealing member 104 is fitted in the second connector connecting chamber 132B in a compressed state. Also, in the sealing member 104 are formed through holes 104*a* in which the terminals 102 are press-fitted at positions communicating with the through holes 103*a* of the partition wall portion 131. In a conventional relay connector 101, by press-fitting the terminals 102 in the through holes 104*a* of the sealing member 104 to bring the terminals 102 and the sealing member 104 into close contact with one another, leakage of oil liquid into the second connector connecting chamber 132B from parts of the first connector connecting chamber 132A in which the terminals 102 are inserted is prevented.

CITATION LIST

Patent Literature

Patent Literature 1: JP 9-245880 A

SUMMARY OF INVENTION

Technical Problem

Meanwhile, the terminal 102 or the connector terminal 102 constituting the aforementioned conventional relay connector 101 is formed by applying press working to a metal plate to punch the metal plate. At this time, as illustrated in FIG. 5, by punching the metal plate by means of a press blade, fine irregularity is generated on a fracture surface of the connector terminal 102. Accordingly, spaces A exist between the irregularity generated on the fracture surface of the connector terminal 102 and the sealing member 104, which causes a problem of a decrease in close contact between the connector terminal 102 and the sealing member 104.

An object of the present invention is to provide a method for manufacturing a connector terminal received in a terminal-receiving chamber, passing through a sealing member, and brought into close contact with the sealing member, and a connector, which are the method for manufacturing a connector terminal, and the connector, for improvement in close contact between the sealing member and the connector terminal.

Solution to Problem

To achieve the above object, one aspect of the present invention is a method for manufacturing a connector terminal received in a terminal-receiving chamber of a housing, passing through a sealing member filled in the terminal-receiving chamber, and brought into close contact with the sealing member, and includes a first process of punching a metal plate to form an intermediate material and a second process of plating the intermediate material.

A first preferred aspect of the present invention is the invention according to the one aspect of the present invention, wherein, in the first process, the intermediate material is formed by punching the metal plate by means of press working while spraying the metal plate with press working oil, and wherein a cleaning process of cleaning the press working oil applied on the intermediate material is provided between the first process and the second process.

A second preferred aspect of the present invention is a connector including the connector terminal manufactured in the manufacturing method according to the one or the first preferred aspect of the present invention, a housing including a terminal-receiving chamber receiving the connector terminal, and a sealing member filled in the terminal-receiving chamber in a state in which the connector terminal is received in the terminal-receiving chamber, wherein the connector terminal passes through the sealing member and is brought into close contact with the sealing member.

A third preferred aspect of the present invention is the connector according to the second preferred aspect of the present invention, wherein the intermediate material is configured to include a plurality of bar members and a connecting portion connecting the plurality of bar members, and the connector terminal is obtained by plating the intermediate material and thereafter cutting a border part between each of the bar members and the connecting portion, wherein a cut surface of the connector terminal at the border part between each of the bar members and the connecting portion has a non-plated portion, and wherein the non-plated portion is situated at a position not contacting the sealing member.

Advantageous Effects of Invention

According to the one aspect of the present invention, since the connector terminal received in the terminal-receiving chamber of the housing, passing through the sealing member filled in the terminal-receiving chamber, and brought into close contact with the sealing member is formed by punching the metal plate to form the intermediate material and plating the intermediate material, irregularity on a fracture surface of the intermediate material generated at the time of punching of the metal plate is filled with the plating. Accordingly, the fracture surface of the intermediate material is formed to be smooth, and close contact between the connector terminal and the sealing member can be improved.

According to the first preferred aspect of the present invention, since, in the first process, the intermediate material is formed by punching the metal plate by means of the press working while spraying the metal plate with the press working oil, and the cleaning process of cleaning the press working oil applied on the intermediate material is provided between the first process and the second process, the press working oil does not remain on the surface of the connector terminal, which prevents foreign matters from attaching to the surface of the connector terminal, close contact between the connector terminal and the sealing member can further be improved.

According to the second preferred aspect of the present invention, since the connector includes the connector terminal manufactured in the manufacturing method according to the one or the first preferred aspect of the present invention, the housing including the terminal-receiving chamber receiving the connector terminal, and the sealing member filled in the terminal-receiving chamber in a state in which the connector terminal is received in the terminal-receiving chamber, and the connector terminal passes through the sealing member and is brought into close contact with the sealing member, irregularity on a fracture surface of the intermediate material generated at the time of punching of the metal plate is filled with the plating. Accordingly, the fracture surface of the intermediate material is formed to be smooth, and close contact between the connector terminal and the sealing member can be improved.

According to the third preferred aspect of the present invention, the intermediate material is configured to include the plurality of bar members and the connecting portion connecting the plurality of bar members, and the connector terminal is obtained by plating the intermediate material and thereafter cutting the border part between each of the bar members and the connecting portion, the cut surface of the connector terminal at the border part between each of the bar members and the connecting portion has the non-plated portion, and the non-plated portion is situated at the position not contacting the sealing member. Thus, a part of the connector terminal covered with the plating is situated at a position contacting the sealing member. Accordingly, close contact between the connector terminal and the sealing member can be achieved reliably.

DESCRIPTION OF EMBODIMENTS

Figure 1:
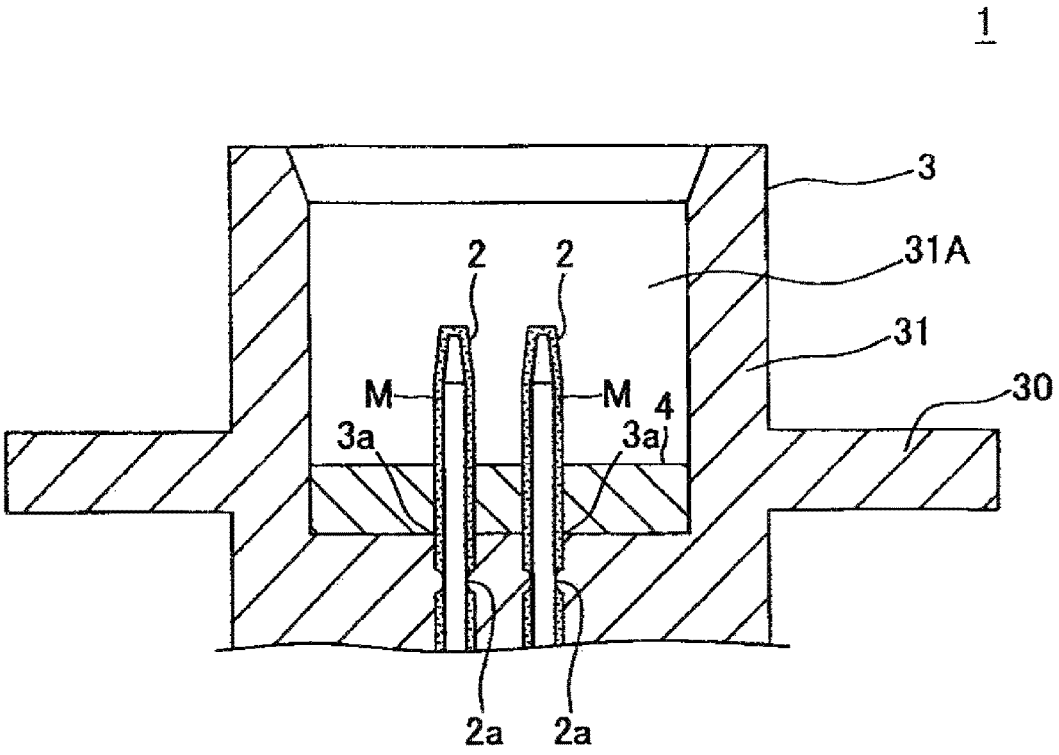
FIG. 1 is a cross-sectional view of a connector including a connector terminal according to an embodiment of the present invention.

A connector according to an embodiment of the present invention will be described with reference to FIGS. 1 to 3. The connector composes a wiring harness to be arranged in an automobile or the like and includes two relay terminals 2 (connector terminals) to be attached to terminals of wires constituting the wiring harness (not illustrated), a housing 3 having a terminal-receiving chamber 31A receiving the two relay terminals 2, and a sealing member 4 filled in one terminal-receiving chamber 31A by injecting therein thermoset liquid silicone, which is hardened when it is heated in a state in which the two relay terminals 2 are received in the terminal-receiving chamber 31A, as illustrated in FIGS. 1 and 2A to 2D.

Each of the two relay terminals 2 is formed approximately in a prismatic columnar bar shape, and female terminals of not-illustrated opposing connectors are connected to one end side and the other end side of each relay terminal 2.

Figure 2A:
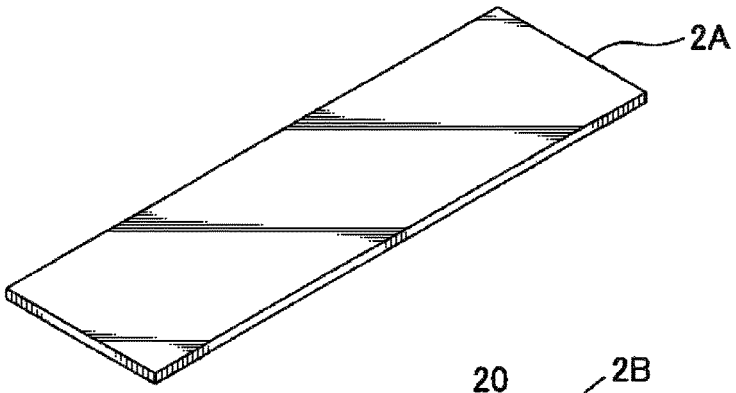
FIG. 2A is a perspective view describing processes of manufacturing the connector terminal illustrated in FIG. 1.
Figure 2B:
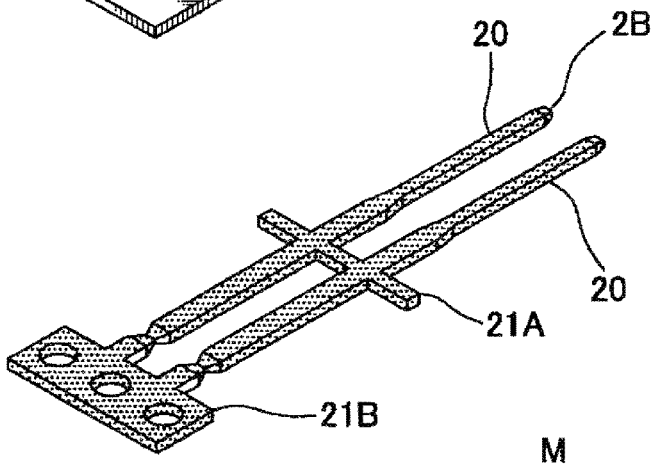
FIG. 2B is a perspective view describing processes of manufacturing the connector terminal illustrated in FIG. 1.

A method for manufacturing the relay terminals 2 will be described with reference to FIGS. 2A to 2D. A non-plated metal plate 2A is punched by means of press working while being sprayed with press working oil as illustrated in FIG. 2A to form a press forming portion 2B (intermediate material) as illustrated in FIG. 2B (first process). The press forming portion 2B is configured to include a plurality of bar members 20 (two bar members 20 in the illustrated example) each having an equal external shape to the relay terminal 2 and two connecting portions 21A and 21B connecting the plurality of bar members 20. One (connecting portion 21A) of the two connecting portions 21A and 21B is provided at a middle part in the longitudinal direction of each bar member 20 while the other (connecting portion 21B) is provided at one end part in the longitudinal direction of each bar member 20.

Figure 2C:
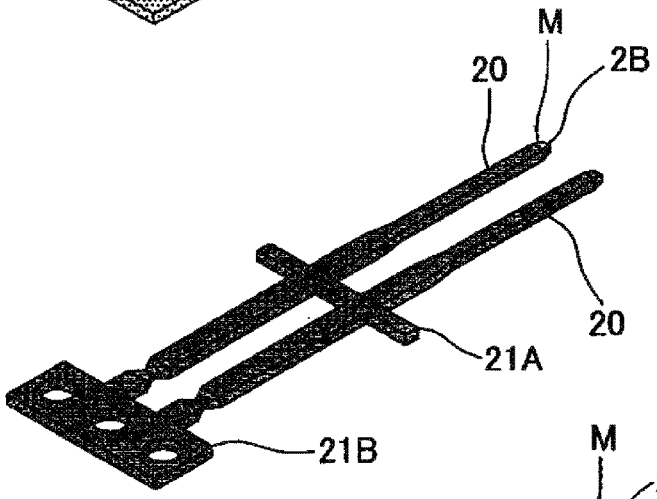
FIG. 2C is a perspective view describing processes of manufacturing the connector terminal illustrated in FIG. 1.
Figure 2D:
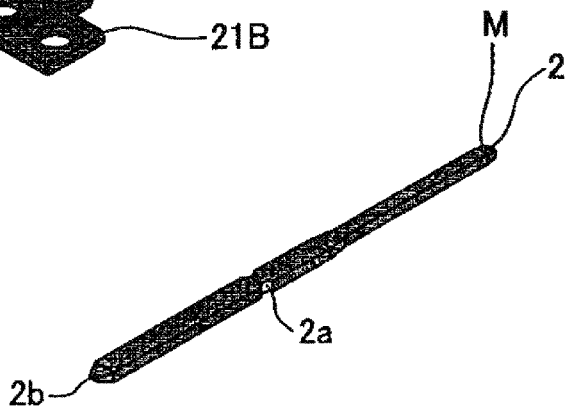
FIG. 2D is a perspective view describing processes of manufacturing the connector terminal illustrated in FIG. 1.

The press working oil is applied on the surface of this press forming portion 2B. Subsequently, the press working oil applied on the press forming portion 2B is cleaned (cleaning process). Subsequently, as illustrated in FIG. 2C, the press forming portion 2B from which the press working oil has been cleaned is covered with plating M (second process). Finally, as illustrated in FIG. 2D, border parts between the bar members 20 and each of the two connecting portions 21A and 21B in the press forming portion 2B covered with the plating M are cut to form the two relay terminals 2. Cut surfaces 2*a* and 2*b* at the two border parts between the bar member 20 or the relay terminal 2 and the connecting portion 21A are non-plated surfaces. Each of the two cut surfaces 2*a* and 2*b* corresponds to a non-plated surface, that is, "a non-plated portion," in the one or the preferred aspects of the present invention.

The housing 3 is made of an insulating synthetic resin by means of known injection molding. This housing 3 includes a flat-plate-like partition wall 30 having through holes 3*a* through which the respective relay terminals 2 pass and a pair of hood portions 31 (only one is illustrated in the example) erected from this partition wall 30 in tubular shapes and having formed therein the terminal-receiving chamber 31A as illustrated in FIG. 1. The through holes 3*a* formed in the partition wall 30 are formed to be smaller than the cross-sections of the relay terminals 2, and the respective relay terminals 2 are press-fitted in these through holes 3*a* and are attached to the housing 3.

Next, a method for assembling a connector 1 including the relay terminal 2 manufactured in the aforementioned manufacturing method will be described. First, in advance, the relay terminal 2 is manufactured in the aforementioned method, and the housing 3 is manufactured by means of injection molding. The relay terminal 2 is attached to the housing 3 and is received in the terminal-receiving chamber 31A by moving one end portion thereof close to the through hole 3*a* of the housing 3 and press-fitting it into the through hole 3*a*. The non-plated surface or the cut surface 2*a* of the relay terminal 2 is situated in the through hole 3*a* of the partition wall 30 (illustrated in FIG. 1). In this state, the molten liquid silicone is injected into the terminal-receiving chamber 31A to the extent that one end portion (cut surface 2*b*) of the relay terminal 2 is exposed and is heated and hardened to form the sealing member 4, and the connector 1 is assembled. At this time, the cut surfaces 2*a* and 2*b* of the connector terminal 2 are provided at positions not contacting the sealing member 4.

Figure 3:
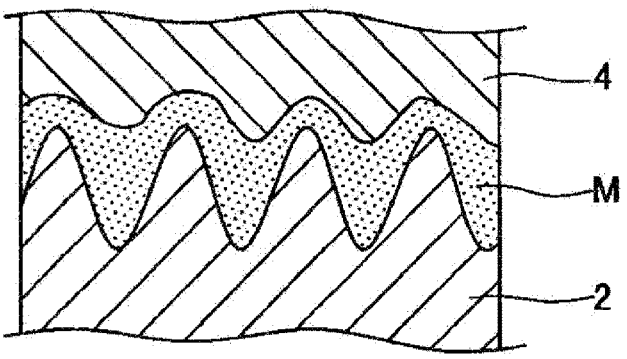
FIG. 3 is an enlarged view of a main part of the connector terminal illustrated in FIGS. 2A to 2D and a cross-sectional view describing effects of the present invention.
Figure 4:
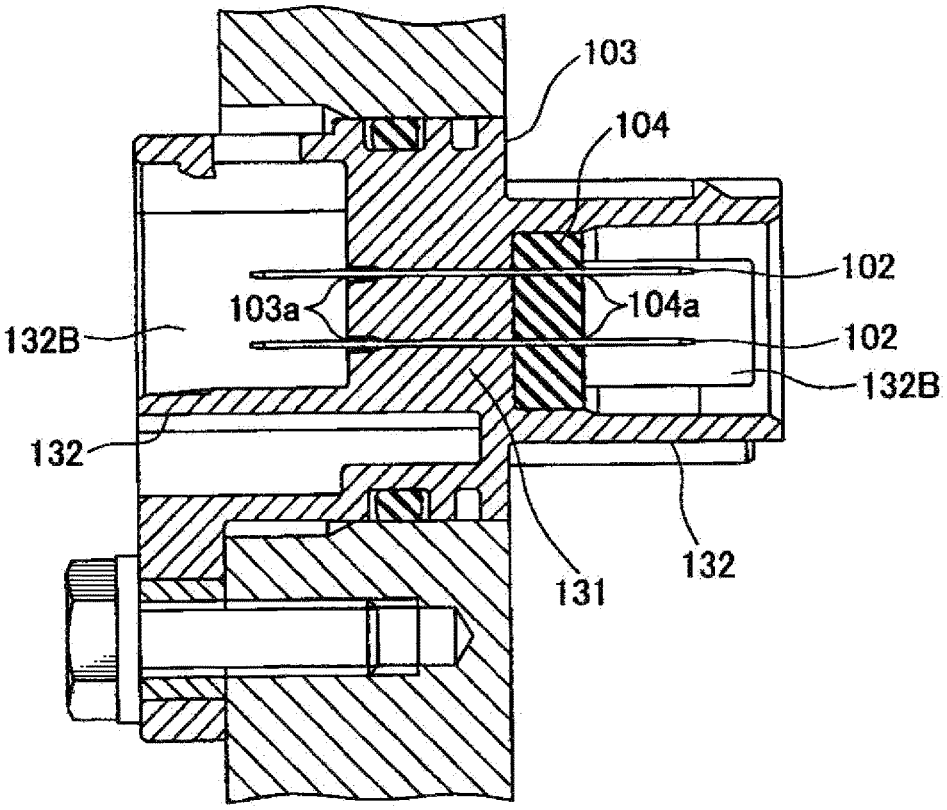
FIG. 4 PRIOR ART
FIG. 4 is a cross-sectional view of a connector including a conventional connector terminal.
Figure 5:
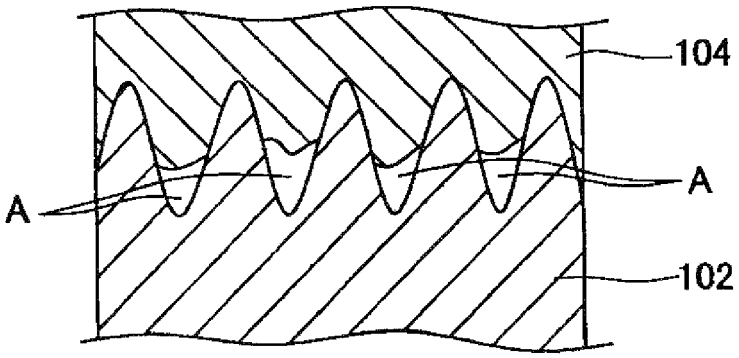
FIG. 5 PRIOR ART
FIG. 5 is an enlarged view of a main part of the conventional connector terminal illustrated in FIG. 4 and a cross-sectional view describing problems of the conventional connector terminal.

In the relay terminal 2 included in the connector 1 assembled in this manner, irregularity on a fracture surface of the press forming portion 2B generated at the time of punching of the metal plate 2A is filled with the plating M as illustrated in FIG. 3. Accordingly, the fracture surface of the press forming portion 2B is formed to be smooth, and close contact between the relay terminal 2 and the sealing member 4 can be improved.

Also, since the press working oil does not remain on the surface of the relay terminal 2, which prevents foreign matters from attaching to the surface of the relay terminal 2, close contact between the relay terminal 2 and the sealing member 4 can further be improved.

Also, since the cut surface 2*a* of the relay terminal 2 has the non-plated portion, and the non-plated portion is situated at a position not contacting the sealing member 4, a part of the relay terminal 2 covered with the plating M is situated at a position contacting the sealing member 4. Accordingly, close contact between the relay terminal 2 and the sealing member 4 can be achieved reliably.

Also, although the relay terminal 2 is formed with use of the non-plated metal plate 2A in the foregoing embodiment, the present invention is not limited to this, and a plated metal plate may be punched to form an intermediate material, and the intermediate material may then be plated again to form the relay terminal 2.

Also, although the press forming portion 2B is configured to include the plurality of bar members 20 each having an equal external shape to the relay terminal 2 and the two connecting portions 21A and 21B connecting the plurality of bar members 20 in the foregoing embodiment, the present invention is not limited to this, and the press forming portion 2B may include only one bar member 20. That is, the two connecting portions 21A and 21B may be omitted.

Also, although each of the relay terminals 2 is formed approximately in the prismatic columnar bar shape, and the female terminals of the opposing connectors are connected to one end side and the other end side of each relay terminal 2 in the foregoing embodiment, the present invention is not limited to this, and a female terminal of an opposing connector may be connected to one end side of each relay terminal 2, and the other end side thereof may be soldered to a circuit board.

It is to be noted that the foregoing embodiment is illustrative only, and that the present invention is not limited to the embodiment. That is, the present invention can be altered in various manners without departing from the scope of the present invention.

REFERENCE SIGNS LIST

1 Connector
2 Relay terminal (connector terminal)
2*a* Cut surface of relay terminal
2A Metal plate
2B Press forming portion (intermediate material)
3 Housing
4 Sealing member
20 Bar member
21A, 21B Connecting portion
31A Terminal-receiving chamber
M Plating

The invention claimed is:

1. A connector comprising:

a connector terminal, the connector terminal having a punch formed intermediate material, a plating formed on the intermediate material, and a cut surface forming a non-plated portion a housing including a terminal-receiving chamber receiving a the connector terminal; and a sealing member filled in the terminal-receiving chamber in a state in which the connector terminal is positioned in the terminal-receiving chamber, wherein the connector terminal passes through the sealing member and the connector terminal is brought into close contact with the sealing member, wherein the intermediate material is configured to include a plurality of bar members and a connecting portion connecting the plurality of bar members, and the connector terminal is obtained by plating the intermediate material and thereafter cutting a border part between each of the bar members and the connecting portion, wherein the cut surface of the connector terminal is formed at the border part between each of the bar members and the non-plated portion is disposed at the connecting portion, and wherein the non-plated portion is situated at a position in the housing and not contacting the sealing member.

* * * * *